US005465566A

United States Patent [19]

Edwards et al.

[11] Patent Number: 5,465,566

[45] Date of Patent: Nov. 14, 1995

[54] ALTERNATE TWIST-PLIED YARN

[75] Inventors: Donald W. Edwards, Wilmington; Craig A. Jackson, Seaford, both of Del.; Steven K. Shibata, Salisbury, Md.; Paul W. Yngve, Chapin, S.C.

[73] Assignee: E. I. Du Pont de Nemours and Company, Wilmington, Del.

[21] Appl. No.: 72,642

[22] Filed: Jun. 8, 1993

[51] Int. Cl.[6] ..... D01H 13/28; D02G 3/28

[52] U.S. Cl. ..... 57/204; 57/236; 57/293; 57/297

[58] Field of Search ..... 57/204, 205, 202, 57/22, 293, 294, 236, 297

[56] References Cited

U.S. PATENT DOCUMENTS

| | | | |
|---|---|---|---|
| 3,184,354 | 2/1962 | Strother | 156/73 |
| 3,184,363 | 2/1962 | Strother | 156/433 |
| 3,434,275 | 4/1967 | Backer et al. | 57/139 |
| 3,616,064 | 4/1968 | Long et al. | 156/433 |
| 3,837,950 | 9/1974 | Reimels | 156/73 |
| 4,103,481 | 8/1978 | Vukoje | 57/293 X |
| 4,173,115 | 11/1979 | Chambley et al. | 57/293 |
| 4,206,589 | 6/1980 | Markey et al. | 57/293 |
| 4,504,539 | 3/1985 | Petracek et al. | 428/195 |
| 4,870,813 | 10/1989 | Nelson | 57/236 X |
| 4,873,821 | 10/1989 | Hallam et al. | 57/293 |
| 5,003,763 | 4/1991 | Hallam et al. | 57/297 |
| 5,012,636 | 5/1991 | Hallam et al. | 57/204 |
| 5,179,827 | 1/1993 | Tinsley et al. | 57/204 |
| 5,228,282 | 7/1993 | Tinsley et al. | 57/333 |

FOREIGN PATENT DOCUMENTS 2022154 5/1979 United Kingdom .

*Primary Examiner*—Daniel P. Stodola
*Assistant Examiner*—William Stryjewski

[57] ABSTRACT

A system for bonding alternate S and Z twist plied yarn. The system bonds the plied yarns as they move in a path through the process and permits balanced expansion of the yarn while preventing lateral movement out of the path. The bonding of the yarn strands while plied together, forms a bond characterized by a dense region of filaments adhesively joined together where one of the strands overlaps another strand, followed by a less dense region along the one strand where fewer filaments are adhesively joined, followed by another dense region.

7 Claims, 9 Drawing Sheets

FIG.5
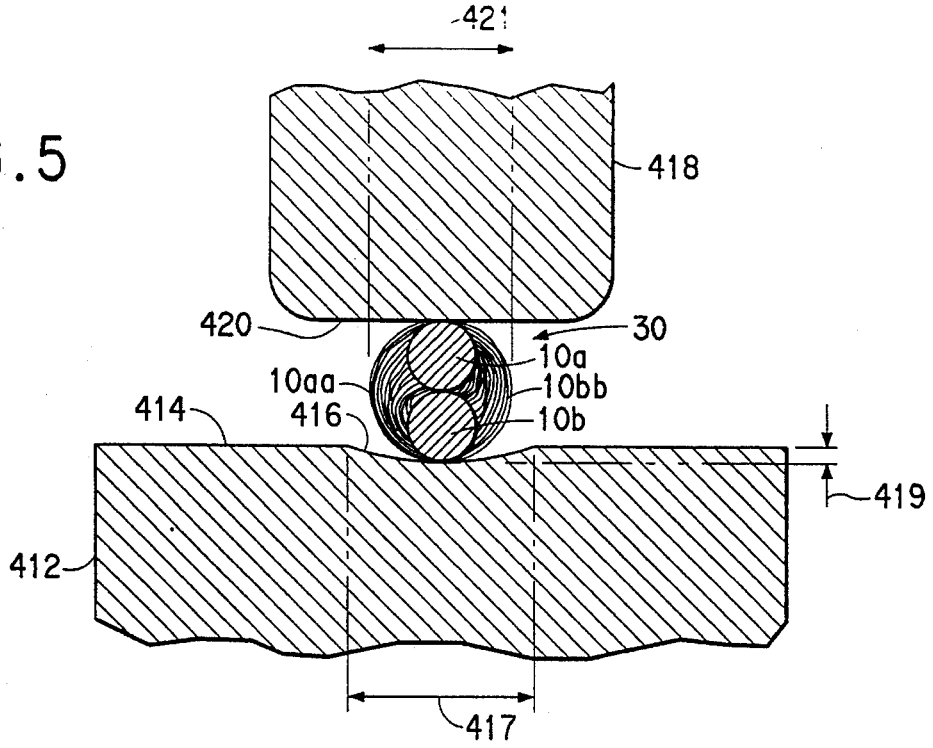
FIG.6
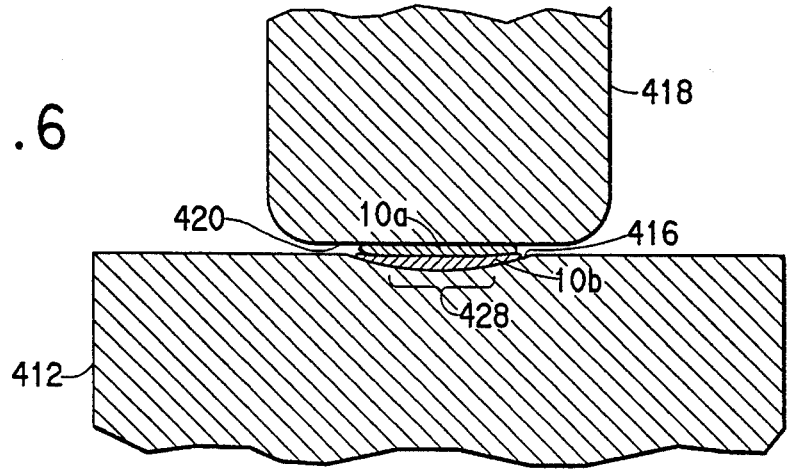
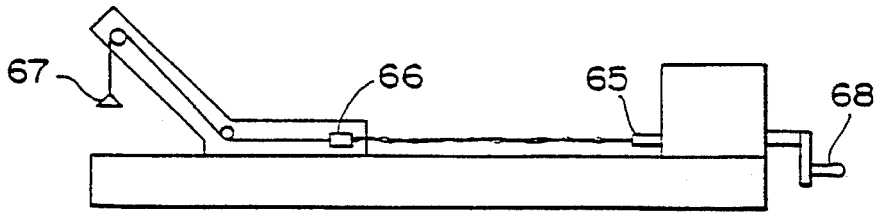
FIG.7

ALTERNATE TWIST-PLIED YARN

BACKGROUND OF THE INVENTION

U.S. Pat. Nos. 4,873,821; 5,003,763; and 5,012,636 describe a process apparatus and yarn product where alternate twist plied yarn is twisted in a first half-cycle of ply twist and is bonded while ply twisted and before the twist is reversed for the second half-cycle of ply twist. The yarn is bonded using an ultrasonic horn and anvil, the anvil having an elongated slot with a width slightly greater than the diameter of a single strand of yarn and a depth about equal to the combined diameters of the plurality of yarns ply-twisted together. The horn is a narrow rectangular blade shape with the thickness dimension being a close clearance fit with the width of the slot in the anvil; the clearance is slightly more than the diameter of an individual filament of the multifilament yarn strand. This arrangement produces a bonded portion of ply-twisted yarn that has a generally "U" shaped cross-section where the sides of the "U" have a small number of loosely gathered filaments and the bottom of the "U" has a large number of densely packed filaments. These patents teach that to make an ultrasonic bond between two or more strands of yarn, the strands should be essentially constrained around the circumference of the ply twisted strands, and compacted while applying ultrasonic energy. Adhesive joining occurs between all the compacted filaments. The loosely gathered filaments in the completed bond discussed above are only those that fit into the minimum clearance required between the closely fitting horn blade and anvil slot. The bonding tooling has the yarns constrained in the direction of motion of the moveable tool, and laterally, i.e. in a direction perpendicular to the direction of motion of the moveable tool.

The process and apparatus of the referenced patents produces a strong bond when the equipment is new and accurately adjusted. There is a problem during use, however, that the alignment between the closely fitting horn and anvil deteriorates and wear occurs. By contact with the sides of the anvil slot, the horn blade width may wear down 15%–30% in routine use which reduces the number of filaments compacted and the only filaments joined are those squeezed under the horn. The corners of the horn are sharpened by the wearing action so that the yarn filaments contacted by the sharp corners may be cut. This wear, then, leads to poor bonds. When the twist of the yarn strands is reversed adjacent a poor bond, the strand twisting force is sometimes strong enough that the poor bond is peeled apart. This is particularly true if the bond is still hot and softened from the bonding process. The poor bond may also have weakened filaments so that tensile forces used to advance the yarn are sufficient to break some of the strands at the bond, which may occur if the bond sticks momentarily in the narrow anvil slot or when the yarn is processed later. Broken strands or peeled apart bonds create processing problems and are not acceptable in the final alternate twist plied yarn product that is often used in a carpet structure. A "missed bond", where the strands are not held together adjacent to the twist reversal, permits the strands to un-ply for a distance of several inches which results in a fuzzy streak in a cut pile tufted carpet.

The bonds taught in the referenced patents also make a "stiff" segment in the yarn where the polymer has been softened and re-solidified throughout the bonded region; the adhesive joining in a good bond involves most of the filaments of the strands used. There is a need for a "softer" bond that has a higher fraction of loosely gathered filaments and is not noticeable when it appears in the tuft of a cut pile carpet. A stiff bond is also sometimes detrimental when the alternate twist plied yarn is used in a tufting machine to make carpet. Occasionally, the bond is in the eye of the tufting needle just as the needle is penetrating the primary carpet backing; the yarn at the ends of the bond is then subject to a high stress as the bond is forced through the backing. This may result in breaking of the yarn at the bond. U.S. Pat. No. 5,179,827 describes a soft bond, but there are very few filaments adhesively joined and the process is difficult to control, so the bond may fail as a result; or as the horn wears, a different bond is produced which is often stiff. Reliability is a problem since the process uses a close fitting horn and anvil configuration as just discussed.

There is a need for a more flexible bond that will bend when it is in the eye of the tufting needle just as the needle is penetrating the backing. Such a flexible bond may also have the benefit of being less obvious when it appears in a tuft of a cut pile carpet; it should compress and deflect and have loose filaments present to more closely resemble the cut un-bonded tufts.

In summary, there is a need for a bonding process that is less sensitive to wear and alignment of horn and anvil components and which will reliably produce a more robust bond that will withstand a greater peel force and tensile force without failure. There is a need for a bonded alternate twist plied yarn that has a more flexible bond and one that has a high fraction of loosely gathered filaments in the bond.

SUMMARY OF THE INVENTION

The invention is a process for making bonds in alternate ply-twisted yarn before the plying is reversed by positioning the yarn between opposed surfaces with one strand overlapping and underlapping another strand, squeezing the yarn in the direction of movement of the opposed surfaces and permitting balanced expansion of the yarn while preventing lateral movement.

The invention is also a bond that has a first dense region of filaments adhesively joined together where a first strand overlaps another strand and a second dense region of filaments adhesively joined together where the first strand underlaps another strand, and a third region between the first and second regions where the first strand is arranged side-by-side with another strand, the third region being less dense with fewer filaments adhesively joined. In one embodiment the level of plytwist in the bond is higher than the average level in the unbonded yarn.

In another embodiment of the bond, there is a longitudinal portion intermediate the ends of the bond where the filaments across the bond are loosely gathered and freely moveable relative to adjacent filaments, thereby providing a flexible portion in the bond. In another embodiment, there is a large fraction of loosely gathered filaments along opposed sides of the bond and the fraction of filaments in dense regions is minimized. The average width of the loosely gathered fraction is more than 40% of the total average width of the bond.

The new bonds can be made with tooling that does not require closely fitting parts that wear during use. In one embodiment, the tooling consists of an ultrasonically energized cylindrical horn with a substantially flat end surface opposed to a substantially flat anvil surface with one or both surfaces having means to permit balanced expansion and to prevent lateral movement of the yarn during bonding, and having means to position the yarn so it will be squeezed between the opposed surfaces as they move together. The positioning means may be yarn guides at the edge of the surfaces, or yarn guides spaced close to the surfaces; some tension in the yarn aids in positioning.

BRIEF DESCRIPTION OF THE DRAWINGS

FIG. 5 is a section view taken through an alternate embodiment of the horn and anvil of FIGS. 3 and 4.

FIG. 6 shows the horn and anvil of FIG. 5 forced together.

FIG. 7 is a schematic drawing showing a twist counter used for measuring average twist.

DETAILED DESCRIPTION OF THE DRAWINGS

Figure 1:
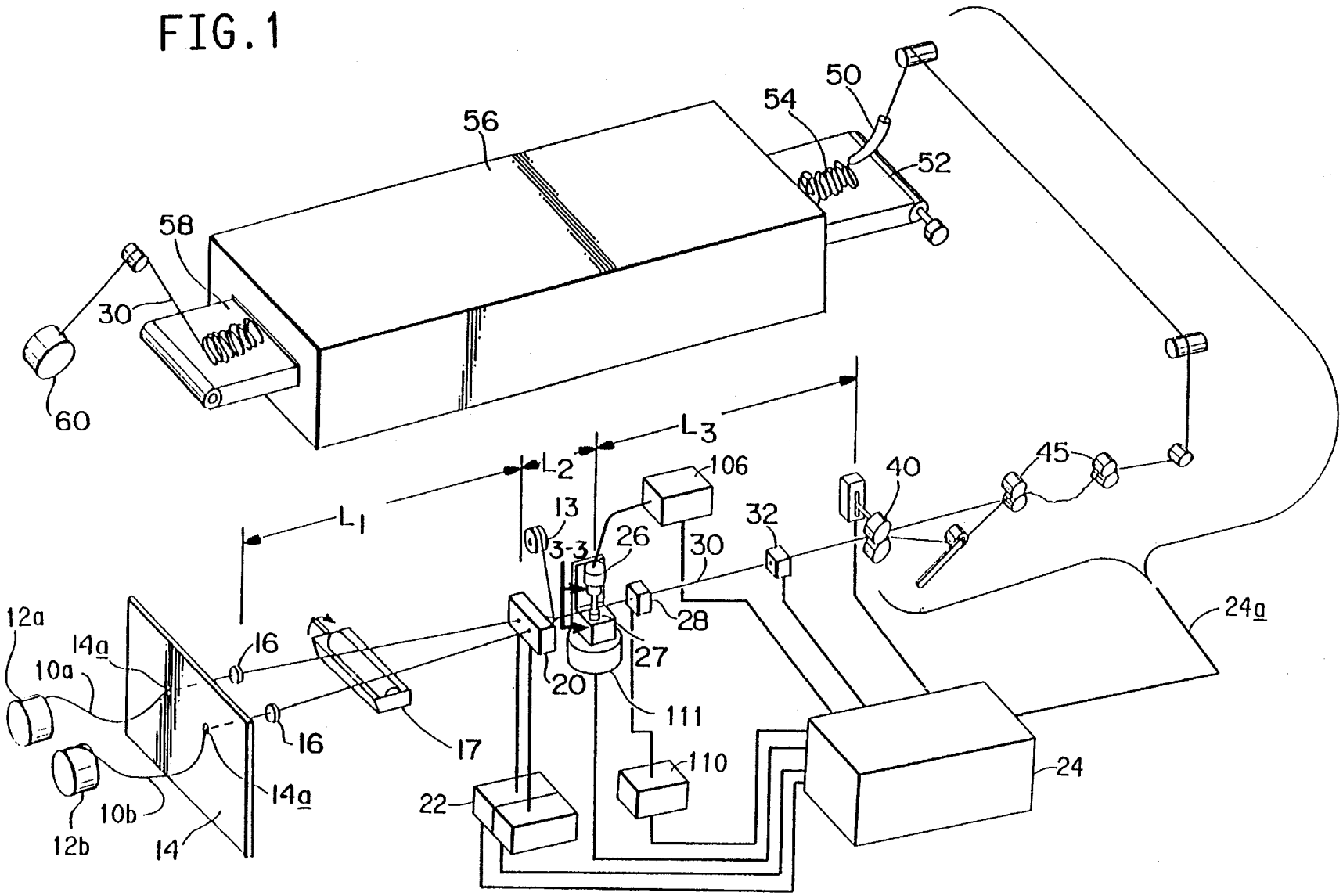
FIG. 1 is a schematic drawings of the apparatus and associated control features, respectively, used in practicing the process of the invention.

Referring to FIG. 1, crimped carpet multi-filament yarn strands 10*a* and 10*b* are taken from supply packages 12*a* and 12*b* through holes 14*a* in baffle board 14 to tensioners 16 over a finish applicator 17 and enter a torque jet or twisting jet, such as that shown in more detail in U.S. Pat. No. 5,179,827, the entire contents of which are hereby incorporated herein by reference. Compressed air is admitted to two passages of torque jet 20 by pneumatic valves 22 which are controlled by controller 24. Torque jet 20 twists yarns 10*a* and 10*b* in alternating directions in the region between tensioners 16 and torque jet 20. The yarn strands are allowed to ply twist together to form plied yarn 30 as they leave torque jet 20, and periodically they are squeezed and bonded together by ultrasonic horn 26 and associated anvil 27 while their forward motion is stopped. A single booster torque jet 28, which is essentially a single passage of torque jet 20, is placed after ultrasonic horn 26 to assist the ply twisting in a manner disclosed in British Patent No. 2,022,154. Plied yarn 30 then passes through puller rolls 40 which grip yarn 30 and accelerate and decelerate the yarn in a cycle controlled by controller 24 in a manner disclosed in U.S. Pat. No. 5,179,827. If desired, a tension transducer 32 to detect instantaneous tension in plied yarn 30 may be placed between booster jet 28 and puller rolls 40, and the output of the transducer may be used to assist automatic or manual control of the cycle. If a yarn, such as an antistatic yarn, is to be added, it may be fed from package 13 through a guide situated between the plying yarns at the exit of torque jet 20. The plied yarn 30 may comprise more than the two twisted yarns shown, simply by adding more supply packages, baffle board holes, tensioners, and torque jet passages. In addition, two or more yarns may be fed to a single torque jet passage for special effects.

Figure 2:
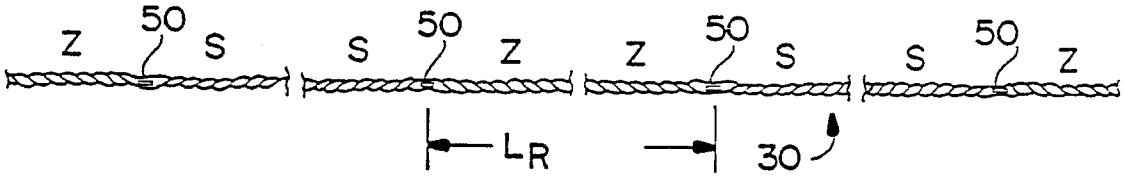
FIG. 2 is a schematic drawing showing several successive sections of reversing twist.

In FIG. 2, the yarn 30 is shown with successive zones of reversing S and Z twist. The twist reversal length, LR, is the distance between reversal nodes 50 which are adjacent the bonds. A complete cycle of alternate ply twist includes two adjacent reversal lengths, one with S twist and one with Z twist.

The distance between the tensioners 16 and the torque jet 20 designated $L_1$ forms a zone, the distance $L_2$ between torque jet 20 and ultrasonic horn 26 forms another zone and the distance $L_3$ between the ultrasonic horn 26 and the take up rolls 40 forms a third zone.

Yarn 30 may then be wound on a package or alternatively may go directly to laydown device 50 which deposits them on travelling belt 52 in a pattern of overlapping or continuous spirals of yarn 54. Belt 52 then carries the spirals of yarn 54 into heating tunnel 56 which heats the yarns to set them in the ply-twisted configuration by saturated steam. At the exit end 58 of the tunnel, yarn 30 is removed from the belt and is wound on package 60. More than one of plied yarn 30 may travel through heating tunnel 56 at the same time.

Since the twisting and node fixing operations are intermittent and subsequent operations are continuous, it is desirable to provide a short-term accumulator before the next constant speed device. The simplest expedient is to provide long free distances between the stop and go motion and the continuous motion elements. Since the alternating twist acts as a spring, the yarn itself will act as an accumulator. Other short-term accumulators could be mechanical dancer rolls or pneumatic systems which provide air cross flow to the yarn between two side plates, thus diverting the yarn during periods of low axial tension and releasing the yarn during high axial tension.

The controller 24 may consist of distributed controllers and a programmable controller having the controlled elements connected thereto as shown in FIG. 1. Line 24*a* represents the several connecting lines to the elements within the bracket. The particulars of operating and coordinating the yarn twisting and bonding, and a control system and hardware for carrying out the system of FIG. 1 are well described in the referenced patents and are not the subject of this invention except as is herein noted. Such details will not be repeated as they are possessed by a person skilled in the art of alternate twist ply yarn formation.

Figure 3:
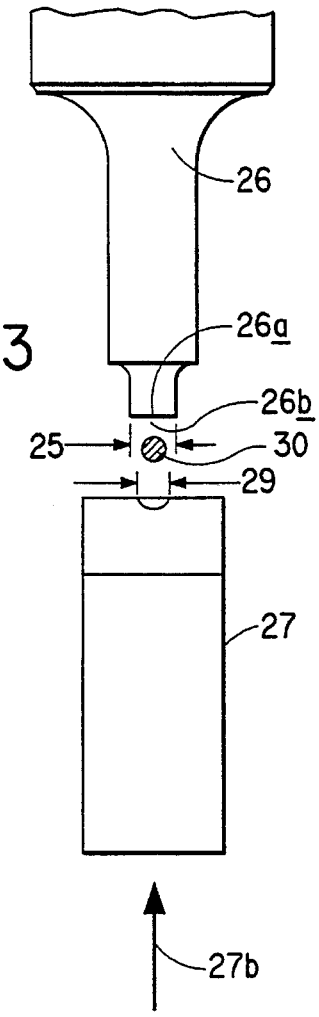
FIG. 3 is a partial elevation view of an ultrasonic horn and anvil for fixing nodes taken along line 3—3 of FIG. 1.
Figure 4:
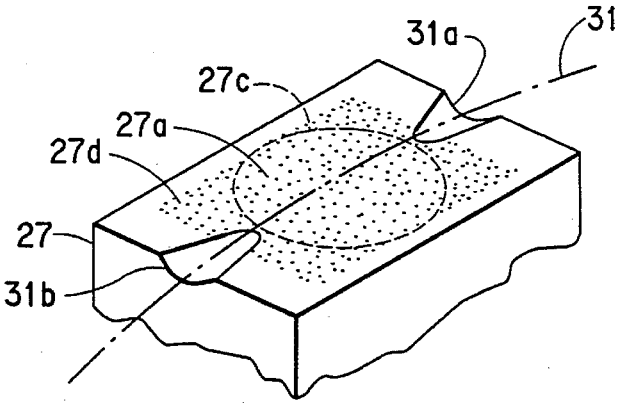
FIG. 4 is an isometric view of the anvil of FIG. 3.

FIGS. 3 and 4 show ultrasonic horn 26 having cylindrical tip 26*a* and associated anvil 27 of FIG. 1 in more detail, wherein ultrasonic horn 26 mates with anvil 27 when the anvil is moved vertically along axis 27*b*. The surface 27*a* on the anvil 27 is opposed to the energizing surface 26*b* of the horn 26. The front and back tapered guide surfaces, designated 31*a* and 3l*b* respectively, are aligned with each other along the yarn path 31 on anvil 27 to help guide the yarn between the opposed surfaces of the horn and anvil. Surface 27*a* supports the yarn for bonding. Dashed line 27*c* shows the footprint of the horn tip 26*a* on the anvil surface 27*a*. The width or diameter 25 of horn tip 26*a* is substantially greater than the diameter of the bundle of ply twisted yarn 30; the maximum width 29 of the tapered guides 31*a* and 3l*b* is sufficient to guide the yarn into position for bonding. Plied yarn 30 normally moves in a straight path into the plane of the FIG. 3 drawing and is normally located just below the tip 26*a* of horn 26. When a node is to be fixed, anvil 27 rises and engages the ply twisted yarn 30 which now follows path 31 along the anvil. The guides 31*a* and 31*b* taper down to a width slightly less than the diameter of the plied yarn to position the yarn between the opposed surfaces 26*a* and 27*a* as anvil 27 rises and engages yarn 30. Anvil 27 continues upward along axis 27*b* and yarn 30 is squeezed between surface 27*a* and the tip 26*a* of horn 26 which is energized, heating the plied yarn and forming a bond that adhesively joins the filaments from strands 10*a* and 10*b*. The horn and anvil, as they come together to squeeze the plied yarn 30, provide for expansion of the yarn. This expansion of the plied yarn bundle, is essentially balanced about the yarn path 31. In the case of the anvil and horn shown, the balanced expansion is along the opposed surfaces, but in other embodiments to be discussed later using a narrow opposed anvil surface, the expansion may occur in any direction beyond the edge of the opposed anvil surface. Lateral motion of the plied yarn away from the yarn path 31 needs to be prevented, especially if one of the opposed surfaces has a narrow width less than the yarn diameter. Squeezing of the plied yarn needs to occur along the central axis of the plied yarn where the overlap of the strands is the greatest; away from the central axis the amount of overlap is considerably reduced. The surface 27*a* of the anvil permits expansion of the yarn during squeezing, however, it is preferably not a polished surface that may allow lateral movement or sliding of the plied yarn out of position away from the yarn path 31 due to the squeezing and ultrasonic agitation; preferably the surface is roughened as shown at 27*d* at least along the yarn path to frictionally engage the yarn. Roughnesses of 16 microinches to 1000 microinches on a steel-surfaced anvil have been found to work. A rough surface of about 250 microinches is preferred, so any routine wear caused by the yarn will still result in good bonds. The surface 26*a* of the horn may also be similarly roughened. Surprisingly, good bonds result without having to constrain the yarn circumferentially and compact all the filaments. The plying of the strands about one another holds the filaments together sufficiently so that the necessary compaction for bonding occurs where the strands overlap (that is, over or under lap) between the opposed surfaces of the horn and anvil. Eliminating the need to constrain the yarn circumferentially eliminates the requirement for a close fit between the horn and anvil so the horn can be easily aligned with the anvil; hence, wear caused by the prior art horn blade closely fitting and occasionally contacting the anvil slot is eliminated and strong reliable bonds result.

Other means of permitting balanced expansion while preventing lateral movement of the yarn between the opposed surfaces of the horn and anvil are possible. One alternate embodiment is to place a shallow, elongated, radiused groove in the surface 27*a* of the anvil 27 along the yarn path 31. FIGS. 5 and 6 show such a variation where a modified anvil 412 is shown with shallow groove 416. Groove 416 permits balanced expansion while preventing lateral movement of the yarn during squeezing and ultrasonic agitation. The surface of the groove may or may not be roughened. The width 417 of the groove should be slightly wider than the diameter of the bundle of ply twisted strands. The groove depth 419 should be less than 20% of the diameter 421 of the bundle of ply twisted strands. A ⅛ inch radiused groove surface about 8 mils deep and 88 mils wide has been found to work with a yarn bundle diameter of about 50–60 mils. Yarn under tension in this groove will keep the yarn positioned between the opposing horn and anvil surfaces during bonding. Preferably the groove may have tapered guides at the ends such as anvil 27 to help position the yarn bending over the ends of the anvil. The plied yarn 30 is positioned between opposing surfaces 420 and the surface of groove 416 of the horn and anvil respectively as the anvil rises to engage the yarn 30 and approach horn 418. The cross-section through the horn and anvil and through the yarn has been chosen where one yarn strand, such as 10*a*, is overlapping the other, such as 10*b*. Portions 10*aa* and 10*bb* show the filaments of each strand as they ply about one another beyond the face of the cross-section. Along the longitudinal axis of the groove 416, the relative position of one strand to the other varies due to the plying of the yarns about one another, but the pitch of the plying and the length of the horn along the yarn path are such that there will always be at least two occurrences of one strand, such as 10*a* overlapping the other such as 10*b*, as shown in FIG. 5.

FIG. 6 shows the anvil pressed against the horn to squeeze the yarn a controlled amount. The amount of squeeze can be controlled by the air pressure in a low friction pneumatic actuator 111 (FIG. 1) used to raise the anvil up toward the horn. The anvil can also be moveably mounted and spring supported on the end of the actuator so the spring determines the squeeze force. The cross-sections of the yarns are shown squeezed together so they fill the cross-section view. The plied yarn strands 10*a* and 10*b* have freely expanded within the groove 416 of the anvil 412, but they have been restrained from lateral movement by the radiused surface of groove 416 that tends to direct the yarn toward the center of the groove thereby keeping the yarn positioned along the yarn path. The yarn filaments making up each of the strands 10*a* and 10*b* are heated by the ultrasonic energy from horn 418 where they are squeezed between the two opposing surfaces 420 and the surface of groove 416 of the horn and anvil respectively. The filaments at the edges of the strands beyond the central section 428 may not be squeezed sufficiently that they are adhesively joined, that is, they will not be firmly stuck together. The portions along the length of the yarn where the strands are not overlapping one another will usually also not be adhesively joined, since the squeezing action exerted between the opposing surfaces 420 and the surface of groove 416 will not be squeezing the two strands together when they are positioned side-by-side instead of being positioned with an overlapped relation. Also the thickness of the yarn in a side-by-side relation will be less than in an overlapped relation so the filaments will not be squeezed tightly since the thickest arrangement of strands will stop the rise of the anvil. The horn and anvil of FIGS. 3 and 4, and 5 and 6 allow the squeezed yarn to freely expand without significant lateral movement. The horn requires no close clearance alignment with the anvil so there is no wear of the horn by the anvil in use; this results in a reliable strong bond in the plied yarn. It is preferable that the horn be made of a material which has low acoustic loss; titanium and aluminum are two suitable materials. The portion of the anvil contacting the yarn should be of a material having good wear resistance and anti-stick properties. Suitable materials may be metals or ceramics.

The ultrasonic transducer can be either magneto-strictive or piezoelectric, although a piezoelectric transducer is preferred because of its high electrical to vibrational conversion efficiency. Alternately, the ultrasonic horn and transducer can be made an integral unit, to reduce the overall size and provide a more compact bonding assembly.

The vibratory energy supplied by the ultrasonic horn 26 can be in the frequency range 16–100 kHz, but the preferred resonant frequency range is 20–60 kHz, and the best bonding performance has been obtained at about 40 kHz. The vibrational amplitude of the tip of the horn 26 is in the range 0.0015–0.0030 inches (0.038–0.076 millimeters) peak-to-peak. Throughout the operation of this process the electrical power is preferably delivered to the transducer by power supply 106 (FIG. 1) before starting the bonding of the ply twisted yarn and is in the range 50–80 watts during bonding, resulting in a power density at the bonding tip in excess of 1500 watts/cm$^2$. This high power density is necessary to produce the very short (<50 msec) bonding times. The power supply 106 should include a switch for rapidly switching off the ultrasonic energy to horn 26.

The force applying pressure to the yarn between the anvil and the horn is an important parameter for obtaining a good bond. A squeezing force of about 5–10 pounds has been found to work well with 2-plied strands about 1200 denier each to make a ¼ inch long bond. In operation, the bonding is started by applying pressure to the yarn strands positioned between the horn and the anvil. The horn is energized before the bonding starts and its energy is coupled to the yarn during the time the pressure is applied. To insure a good reliable bond, the horn energy is turned off after a predetermined time (depending on parameters such as yarn type, yarn denier, squeeze force, and strength requirements for the bond) before the squeezing force is removed by retracting the anvil. The anvil is retracted only after the yarn has cooled slightly, say after about 20 milliseconds. After the anvil has retracted, the twisting and forwarding of the yarn can resume and the horn can be reenergized to be ready for the next bond. This is a variation from the teachings of the patents referenced in the background section where it was possible to make fully contained bonds without turning off the ultrasonic energy and delaying the retraction of the anvil. Some resistance of the compacted bond to removal from the prior art anvil slot, as the anvil retracted and uncoupled the ultrasonic energy, may have created a slight cooling dwell that is not inherent with the horn and anvil of the invention that lacks a containment slot. The tension applied to the yarns during bonding assists in consolidating the filaments, and aids in positioning the plied strands on the anvil.

TEST METHODS

AVERAGE TWIST—SAMPLE TO SAMPLE

When a measurement of average twist is desired, a sample of yarn between nodes substantially longer than 25 cm is cut and one end is placed in rotatable clamp 65 of a Model Precision Twist Tester manufactured by the Alfred Suter Co., Inc., Orangeburg, N.Y., U.S.A., shown in FIG. 7. Clamp 66 is attached to the other end of the sample 12.7 cm from clamp 65. Clamp 66 is tensioned by weight 67 of 20 gms and is free to slide axially while being restrained from twisting. Crank 68 is then turned in a direction to unwrap the ply twist until all of the twist is removed. The number of turns required to reach this condition in the 12.7 cm yarn length is registered on a counter and is recorded. The average turns per centimeter is then calculated.

TENSILE STRENGTH OF YARN CONTAINING BOND

A yarn sample containing an ultrasonic bond is cut several inches away from the bond on both sides. Both plies of one end are clamped in one jaw of a tensile test machine and both plies of the other end in the other jaw. As the sample is extended, the bonded node rotates, and at some load all of the yarn strands break at the bond, which can be seen as a sudden drop in the plot of load vs. extension. The sample is pulled at a rate of two (2) inches per minute and the peak load to break the yarn is determined. The tenacity of the plied yarn which does not contain a bond is tested to break, and the breaking strength at the bond as a percent of the breaking strength of the plied yarn is calculated. The peak load may also be compared to the total denier of the plied yarn to express bond tenacity in terms of grams/denier.

PEEL STRENGTH

The force to peel a single strand from the bonded plied yarn is a good indicator of the performance of the bond. If the strand peels completely through the bond, the force is an indicator of the strength of the bond. If the yarn has been "undercooked" by the horn and anvil, a low peel force may be produced so premature bond failure would occur and cause untwisting of the ply. If the strand breaks before completely peeling through the bond, the force is an indicator of the tensile strength of the bonded yarn. If the yarn has been "overcooked" by the horn and anvil, a high peel force may be produced, but the strand at the bond may be weakened to cause premature tensile failure. The peel force is determined by cutting a yarn sample containing an ultrasonic bond and having 5–6 inches of plied yarn on one side of the bond and about ½ inch on the other side. The 5–6 inches of yarn, preferably on the side of the bond where the twist is locked in, is untwisted up to the bond to free the individual strands. One strand is placed in one jaw of a tensile test machine and another strand is placed in the other jaw; any additional strands are allowed to hang free. A strip chart recorder is attached to the machine to record the load versus extension. The sample is pulled at a rate of 2 inches per minute until a) one of the yarns has peeled from the bond which is allowed to freely rotate, or b) one of the yarns breaks. The maximum load is recorded as the peel strength of the bond. This number can be used directly for comparison of bonds, or as a ratio, comparing it to the denier of a single strand, or the tensile strength of a single strand.

BOND RELIABILITY

The reliability of the bond is very important when the yarn is used to make cut pile carpet. If a bond fails, several inches of yarn may un-ply, so when the carpet is tufted, a fuzzy streak appears in the yarn where the cut tuft definition has been lost. A bond failure rate of 1 in 100,000 is considered acceptable to avoid a significant product loss when tufting cut pile carpet. If the yarn peel strength is greater than 3× the standard deviation of the peel strength samples, this is considered adequate to approach the above bond failure rate.

For some carpet styles, such as in a loop pile patterned carpet, missed bonds may be less noticable. Statistically, a deviation of +/− three standard deviations (sigma) will account for 99.73% of all the samples, so if the peel strength minus 3 sigma is greater than zero, there should not be any missed bonds in 99.73% of the samples. Preferably, the peel strength should be greater than 4.4 sigma to better the 1 in 100,000 failure rate. The reliability can be expressed in terms of mean/(std. dev.) which is preferably greater than 3.0 and more preferably greater than 4.4 for the bond of the invention.

AVERAGE PLIED YARN DIAMETER

It is often convenient to use the plied yarn diameter to "normalize" some of the dimensional characteristics of the bond. For repeatability in measuring, the plied yarn diameter, or yarn bundle diameter, is the untensioned average diameter of the plied yarn spaced at least an inch from the end of a bond. Several measurements can be made along a length of yarn by placing a straightened, one inch long section under a microscope with grid lines, or an optical comparator can be used, such as a "Qualifier 30" made by Opticom. With the comparator set at about 20×magnification, the sample of plied yarn is placed horizontally on a block located in the light path of the comparator. The sample is aligned with a horizontal reference line on the comparator screen with the line passing through the peaks and valleys along the edge of the sample to define an average edge location. The line is moved to the opposite average edge of the yarn and the distance moved is recorded as the average diameter of the plied yarn. This is repeated with several samples along the length of yarn to further "average" the diameter. For a rough measurement, a dial caliper can be used and a short straight sample squeezed in the jaws just so it does not fall freely from the jaws.

Figure 8:
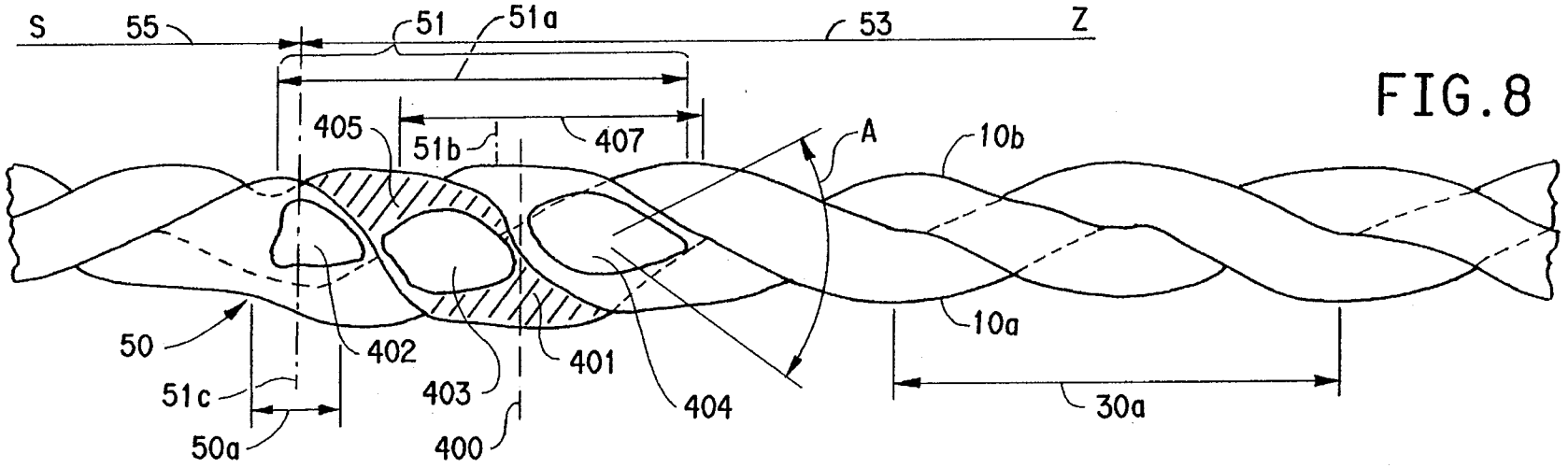
FIG. 8 is an enlarged schematic drawing of a two-ply yarn with a typical bond and reversal node for a yarn of the invention showing the characteristic dense and less dense regions in the bond.

FIG. 8 is an enlarged schematic drawing of a two-strand plied yarn 30 of the invention near a reversal node 50 which has been fixed by the ultrasonic horn 418 and anvil 412 and has bond 51 with a length designated 51*a* which is about the average length of one turn of twist in the unbonded yarn, i.e. length 30*a*. Zone 53 to the right of reversal node 50 is ply twisted in one direction (Z twist) and zone 55 to the left of the reversal node is twisted in the opposite direction (S twist). The degree of twist in zone 53 may be equal to that in zone 55, and the degree of twist may be constant within each of the zones. The center of bond 51 which is designated by line 51*b* and the center of the reversal node 50 which is designated by line 51c are not in alignment with each other and the strands 10*a* and 10*b* are bonded together at an angular relationship to each other as represented by angle A included between lines representing the longitudinal axes of the strands 10*a* and 10*b* at that location. The position of the twisted strands in any cross section of the bond 51 will depend on the instantaneous relationship of the strands 10 to each other when they are squeezed for bonding between the horn and anvil. The reversal node 50 has the unusual characteristic of exceptionally short length 50*a*. Since the bond is made in the ply twisted strands before the ply twist is reversed, the first half-cycle of alternate ply twist is locked-in within the bond in zone 53. When the ply twist is reversed in the second half-cycle of alternate ply twist in zone 55, it originates at one end of the bond without appreciable untwisting of the first half-cycle that is locked-in. This results in an abrupt angle change in the strands at the reversal node. The reversal node length 50*a*, that is the length (measured along the twisted yarn centerline) required to change a strand angle from that of one twist direction to another, is on the order of less than one millimeter for a typical carpet yarn of about 1300 denier per strand. This is, alternatively, less than about one twisted strand diameter or the length of about one-quarter turn of twist of the plied yarn.

The enclosed areas 402, 403, and 404 represent dense regions of the bond 51 where one strand overlapped another strand and they were squeezed tightly between the opposed surfaces of the horn and anvil, and the filaments are adhesively joined. The regions of the bond outside the enclosed areas represent less dense regions where the filaments were not squeezed tightly between the opposing surfaces of the horn and anvil and so have few or no filaments that are adhesively joined. These dense and less dense regions in the bond can be identified in a non-dyed, nylon, ply-twisted yarn by back-lighting a bonded sample under a microscope. The dense regions where the filaments are compacted and adhesively joined pass the light more efficiently than the less dense regions where the filaments are less densely gathered (and hence scatter the light) and few of the filaments are adhesively joined. The dense regions show up as brighter regions than the remainder of the yarn strands.

The bond of the invention can be characterized by the alternating dense/less dense/dense regions that occur in a single strand of multi-filament yarn traced through the bond. A strand is defined as the bundle of filaments twisted in one of the yarn passages of the torque jet. Two or more separate bundles of yarn may be fed to, and be twisted, in one jet passage to become a single strand in the ply-twisted yarn. Referring to strand 10*a* and tracing it from right to left, strand 10*a* first underlaps strand 10*b* at dense region 404. Strand 10*a* then lies side-by-side with strand 10*b* looking at the strands along line 400. The filaments in strand 10*a* on both sides of line 400 define a less dense region, shown as hatched region 401, with fewer filaments adhesively joined. Strand 10*a* then overlaps yarn 10*b* at dense region 403; lies side-by-side with strand 10*b* at less dense region 405; and underlaps strand 10*b* at dense region 402. Looking at strand 10*a* in the bond, then, it has a succession of a dense region followed by a less dense region, followed by another dense region, etc. This is a characteristic that is also desirable for making reliable strong bonds having a plurality of dense adhesively joined regions where the strands overlap.

Figure 9:
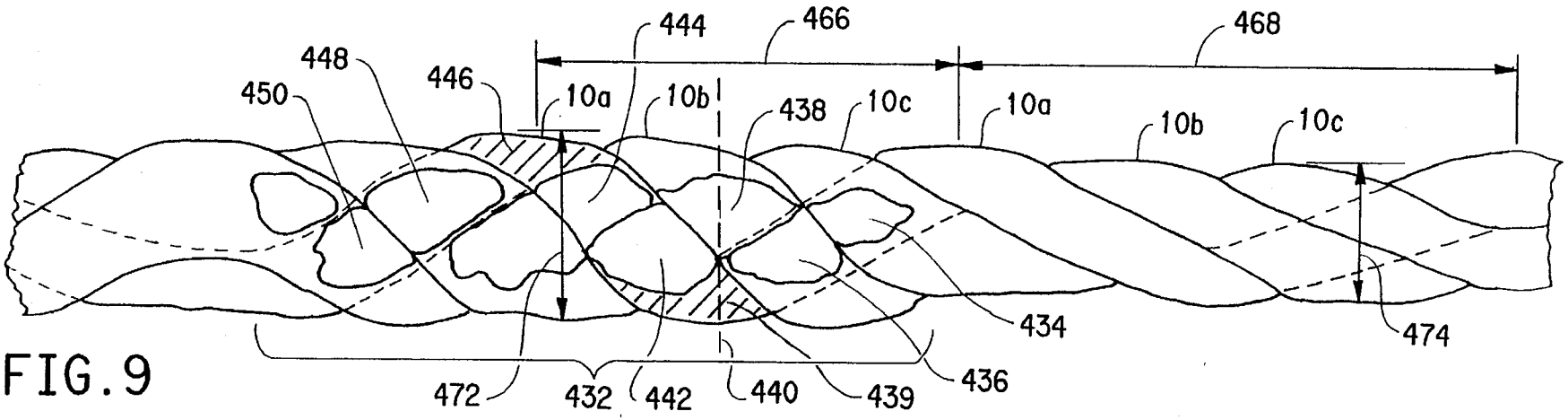
FIG. 9 is an enlarged schematic drawing of a three-ply yarn bond with the characteristic dense and less dense regions in the bond.

Such a characteristic bond can also be identified in a three-strand plied yarn bond such as bond 432 shown in FIG. 9. Referring to strand 10*a* and tracing it in the bond from right to left, strand 10*a* first underlaps strands 10*c* and 10*b* at dense regions 434 and 436 respectively. Strand 10*a* then lies side-by-side with strands 10*b* and 10*c* which overlap one another at dense region 438. The filaments in strand 10*a* define a less dense region, shown hatched at 439, with fewer filaments adhesively joined. Strand 10a then overlaps strand 10*c* and 10*b* at dense regions 442 and 444 respectively. Strand 10*a* then goes on to another less dense region 446 and dense region 448/450 before reaching the left end of bond 432. Strand 10*a* has the dense/less dense/dense pattern characteristic of the bond of this invention.

Figure 10:
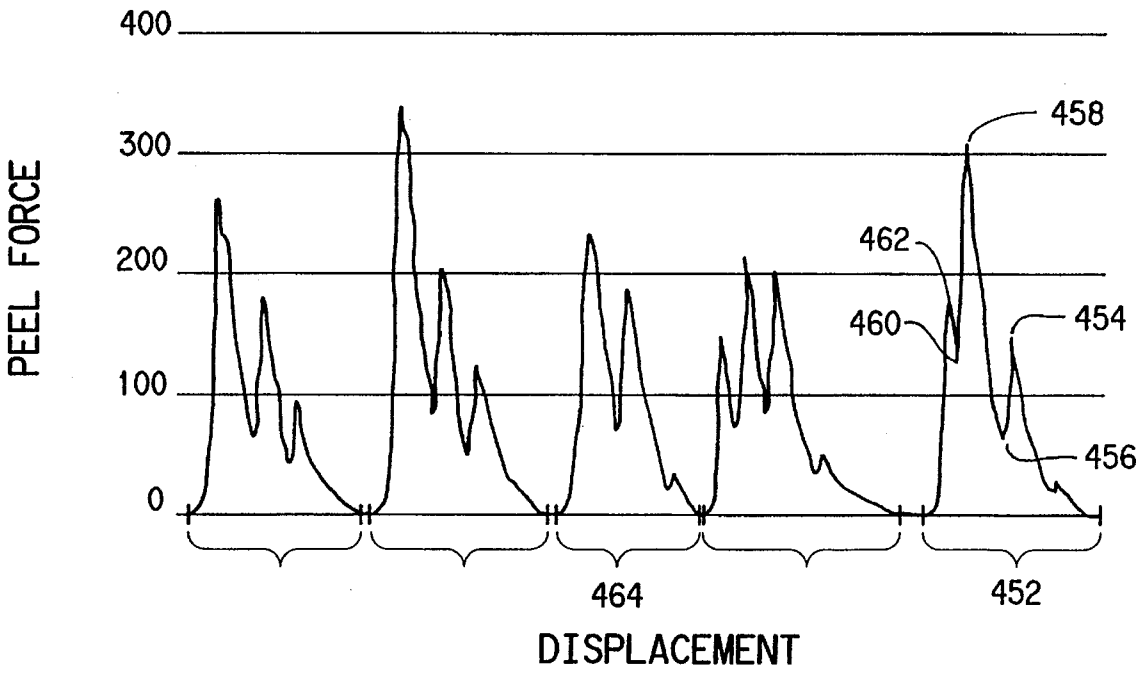
FIG. 10 is a plot of bond peel force versus displacement for a bond of the invention.

The characteristic dense/less dense/dense regions can be identified under a microscope at about 6× to 10× power especially if the sample is backlighted so the light passes through the sample and to the eyepiece of the microscope. The dense regions appear light and the less dense regions appear dark. Another way to detect these characteristic regions is to peel the sample bonds apart by: cutting a sample containing a bond from the yarn; unplying the strands on the side of the bond where the ply twist is locked in; attaching one strand in one jaw of a tensile test machine and another strand in the opposing jaw; pulling on the strands and recording the force-displacement of the machine until the strands have peeled free of the bond. This will produce a force-displacement trace for the bond with distinct peaks where the dense regions are, and valleys where the less dense regions are. FIG. 10 shows one such trace for five bonds made using a roughened flat anvil and mating cylindrical horn (such as in FIGS. 3 and 4), and bonding two ply-twisted strands of nylon BCF yarn with a denier of 1150 per strand. The curves are plotted from right to left starting with sample 452. The first significant peak occurs at 454 and represents a dense region at an overlap where the filaments of a first strand are adhesively joined to another strand; followed by a valley 456 representing a less dense region with the strands side-by-side where fewer filaments are adhesively joined; followed by peak 458, valley 460, and peak 462. This pattern of peel force peaks and valleys is repeated in the other bonds, although in sample 464, there are only two significant peaks and one valley present, due to a slightly lower twist level and the relative position of the overlaps with the edge of the horn. The minimum number of peaks in the new bonds should always be two peaks separated by a valley. The maximum number of peaks/valleys depends on the number of turns per inch of the yarn as it is being bonded, the relative position of these turns to the edge of the energized surface of the horn, and the length of the opposed horn and anvil surfaces.

Figure 11:
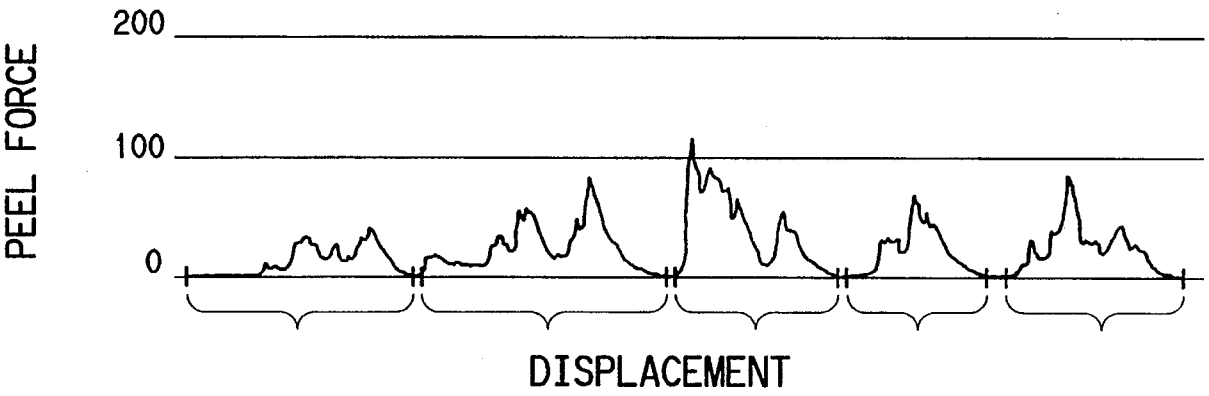
FIG. 11 is a plot of bond peel force versus displacement for a prior art bond made with a horn having routine wear.

FIG. 11 shows a force displacement trace for five bonds of two ply-twisted strands of 1280 denier nylon BCF, bonded according to the referenced patents, but with a horn that was somewhat worn during routine use. With a horn that was not worn, it would be expected that there would only be a single broad peak traced, since all the filaments that are compacted in a new horn and anvil would be adhesively joined continuously at any overlapped portions and at any side-by-side portions. Note the irregular trace lacking well defined peaks and valleys and the overall low values of the peel forces. This trace is substantially different from the trace of FIG. 10.

Figure 12:
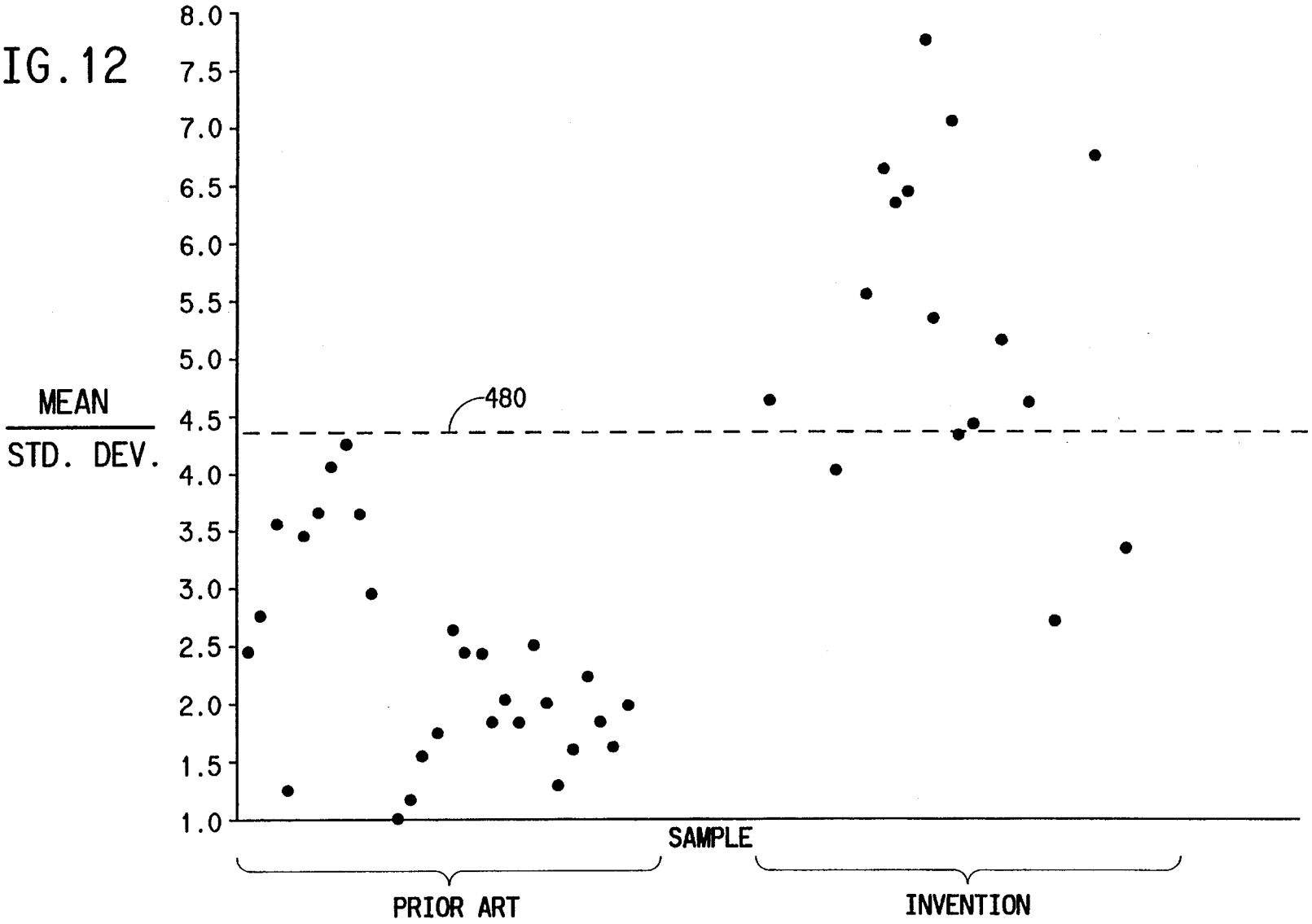
FIG. 12 is a plot of mean peel force divided by peel force standard deviation for bond samples of the invention and the prior art.

The bonds of the invention have a reliably higher peel force than prior art bonds of the referenced patents made with tooling experiencing some degree of wear in routine use. This can be seen when comparing the mean peel force for a sample of a plurality of bonds to the standard deviation for the sample. The bonds of the invention usually have a mean peel force greater than 3× the standard deviation and frequently greater than 4.4× the standard deviation. Prior art bonds usually have a mean peel force less than 3× the standard deviation and nearly always less than 4.4× the standard deviation. This is graphically depicted in FIG. 12 showing the ratio of mean to standard deviation for 28 prior art yarn samples and 16 yarn samples of the invention (each sample point representing data gathered from at least 50 bonds made over about a one week period with the peel force for each bond being the highest force obtained when peeling a bond). Line 480 represents a mean equal to 4.4× the standard deviation which indicates the preferred reliability needed to obtain about 1 missed bond in 100,000 made.

In some embodiments of the bond of the invention, such as the bonds in FIGS. 8 and 9, there is a higher number of turns of twist in the bond compared to the average twist level of the un-bonded yarn. Referring to FIG. 9, the twist level in the bond, represented by the pitch of strand 10*a* in the bond at 466, is about 4.6 turns per inch, while the twist level of the un-bonded yarn, represented by the pitch of strand 10*a* to the right of the bond at 468, is about 3.7 turns per inch. The twist per inch in the bond is about 24% higher than the un-bonded yarn immediately adjacent the bond. Normally the difference would be even higher when the comparison is made to the average twist level of the un-bonded yarn between bonds. A high twist level in the bond is useful for several reasons, such as 1) it compacts the yarn so it does not spread out much laterally during bonding; and 2) it provides many strand overlaps in a short length to improve the reliability of the bond with numerous dense regions, or, 3) alternatively, it permits a shorter bond length while still maintaining at least two dense regions per bond (short bonds may be less noticeable in a cut pile carpet). Preferably, the twist level in the bond should be at least 20% higher than the average twist level of the un-bonded yarn.

It has been found that the twist level in the bond can be increased by increasing the ply twist in the yarn just before bonding. This can be accomplished by turning on the booster torque jet 28 only just before and just as the anvil is being raised to squeeze the yarn against the horn for bonding. It can also be accomplished by delaying the raising of the anvil after the puller rolls 40 have stopped so the motion of yarn 30 has more nearly approached zero while the torque jet 20 is still twisting the strands. Either of these actions puts a high level of ply twist in the yarn between the torque jet and booster jet. After bonding the highly ply twisted yarn, the twisting and plying are reversed and most of the high ply twist adjacent the bond is reduced, so only the bond, where the ply twist is locked in, retains the higher level of ply twist. The relationship between turns of twist in the bond and overlaps in the bond depends on the number of strands being plied together. Referring to the three ply yarn of FIG. 9, for one turn of twist of strand 10*a*, represented by the distance 466, strand 10*a* has four overlaps (represented by dense regions 434, 436, 442, and 444). Referring to the two-ply yarn of FIG. 8 for one turn of twist 407 of strand 10*a*, there are two overlaps (represented by dense regions 404 and 403).

Figure 13:
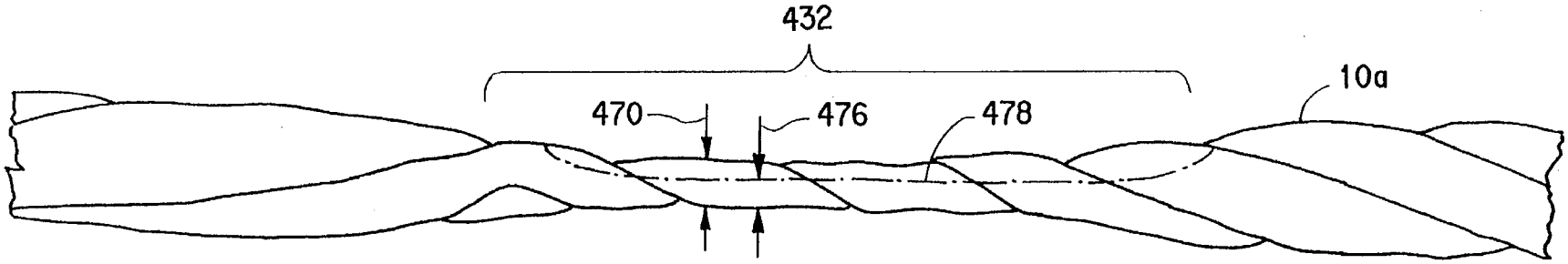
FIG. 13 is a side view of the bond of FIG. 9 showing the minimum border dimension.

FIG. 13 shows a side view of the bond 432 of FIG. 9. The ply-twisted yarn in the bond has a characteristic "flattened" shape as represented by border dimension 470, compared to the view in FIG. 9 where the border dimension 472 is slightly greater than the average diameter of the unbonded plied strand bundle, represented by dimension 474. Minimum border 470 is about 25% of the average plied yarn diameter represented by diameter 474. For other bond configurations of the invention, this minimum border dimension may approach 50% of the unbonded yarn average diameter. The minimum and maximum border dimensions of the bonds of the invention have a unique relationship that can be expressed by the comparison that both the maximum border dimension is greater than or equal to the average plied yarn diameter, and the minimum border dimension is less than 50% of the average plied yarn diameter. In the prior art bonds, the maximum and minimum border dimensions were usually about the same, which were generally smaller than the average plied yarn diameter. Note that the dimension 470 actually includes the "fluffed-up" loosely gathered regions along the sides of the bond. The thickness of the dense region itself would be represented by dimension 476 to the hidden dot-dashed line 478 which is below the sides of the bond. The bond is actually flatter than it appears if the thickness of the dense region is used for comparison. The thickness 476 of this dense region may range from 10%–30% of the average plied yarn diameter and is usually less than 25%.

Figure 14:
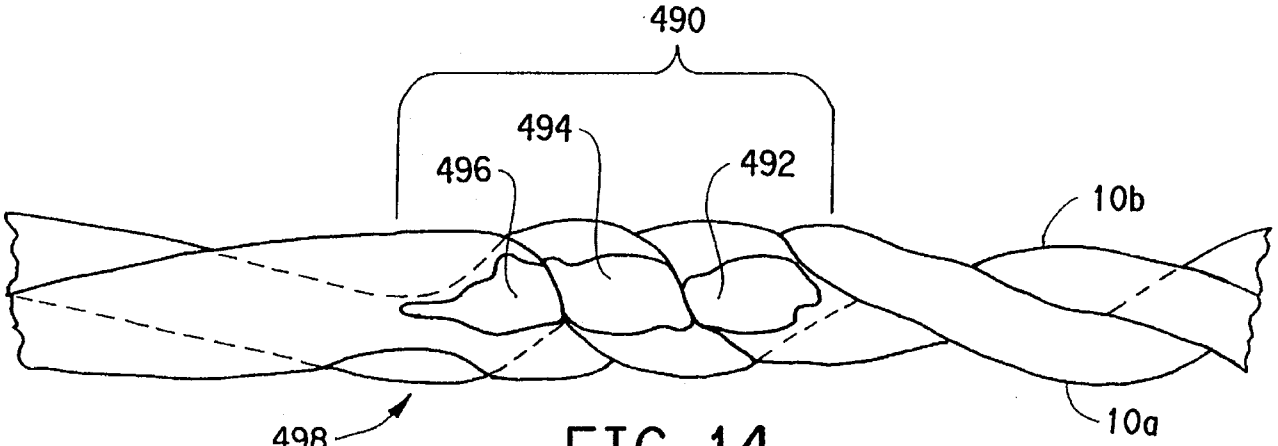
FIG. 14 is an enlarged schematic drawing of a bond showing the dense regions abutting along the central axis.

FIG. 14, shows a two-ply bond made with the horn and anvil of FIGS. 3 and 4. In FIG. 14, bond 490 is made where the strands 10*a* and 10*b* are plied together and squeezed between the horn tip 26*a* and anvil surface 27*a*. The enclosed areas 492, 494, and 496 represent dense regions of the bond 490 where one strand overlapped another strand between the opposed surfaces of the horn and anvil and the filaments are adhesively joined. The ply twist reversal is shown at 498. The dense regions appear abutted along the center axis of the bond.

Figure 15:
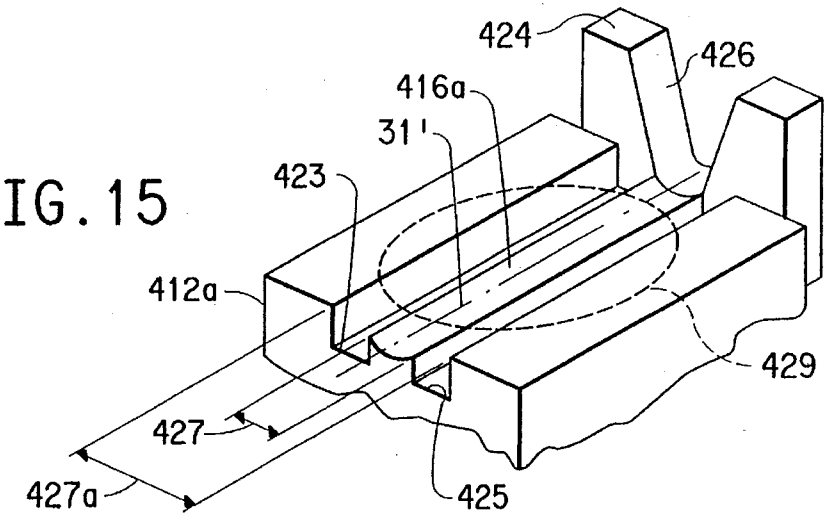
FIG. 15 is an isometric view of an anvil having parallel channels parallel to the yarn path.

The number of adhesively joined filaments in the bonds produced by the anvil and horn of FIGS. 3 and 4, and FIGS. 5 and 6 can be reduced to improve the "softness" of the bond by providing channels along the length of the anvil so some of the filaments along the edges of the yarn do not get squeezed during bonding. Such an embodiment is shown in FIG. 15 where the anvil 412*a* represents a modification of anvil 412 so it has two spaced parallel channels 423 and 425 aligned parallel to the yarn path 31'. The portion of the groove 416 remaining is shown as groove 416*a* which has a width 427 that provides a surface opposing the horn surface 420. The width 427 is defined by the distance between inner edges of channels 423 and 425 and should be between 30% and 60% of the plied yarn average diameter. The outer edges of channels 423 and 425 may be used to help position the yarn for bonding and should be spaced at a distance 427*a* that is equal to or greater than the plied yarn average diameter. Although not specifically illustrated in the figure, the sharp corners on the anvil should be rounded to avoid damage to the yarn filaments. Horn 418 may be used with this anvil and would mate with the anvil as shown by footprint 429. Alternatively, the horn tip may have a footprint having a rectangular or other shape spanning the outer edges of the channels and aligned with the yarn path. Tapered guide 424 has a deep "V" shape cutout 426 aligned with the yarn path 31' and has portions extending above the surface of groove 416*a*. The tapered guide may be mounted to the anvil or may be separately mounted for movement to engage the yarn and position it before squeezing. Guide 424 is useful to help position the yarn for bonding; such a guide would also be positioned at the opposite end of the groove, but is omitted for clarity. When such guides are used, the outer edges of the channels may not be needed for positioning and so would extend out beyond the sides of the anvil and therefore be eliminated. This may be an advantage so occasional filaments are not squeezed against the horn beyond the outer edges of the channels. Alternatively, guides similar to those shown on anvil 27 (FIG. 4) could be used with the outer edges of the channels retained as shown. The filaments in the overlapped strand portions positioned between the surface of groove 416*a* and the horn surface 420 will be adhesively joined, and the filaments positioned at the channels will be loosely gathered and will not be adhesively joined. The filaments of the strands are free to expand beyond the edges of the opposed surface 416*a* into the channels 423 and 425, while the radiused surface of groove 416*a*, with some help from guides, such as 424, prevents lateral movement of the plied yarn away from the yarn path 31'. Alternatively, the radiused surface could be replaced with a roughened flat surface to prevent the lateral movement. This anvil used with horn 418 of FIG. 5 and 6 can produce a bond resembling bond 500 of FIG. 16.

Figure 16:
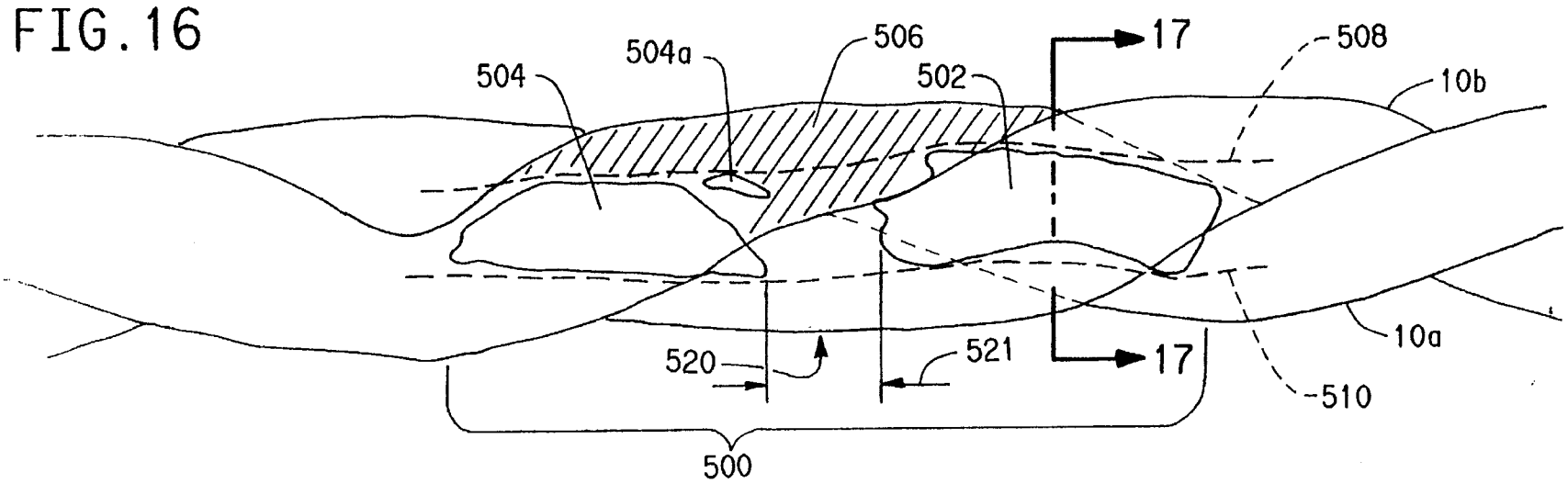
FIG. 16 is an enlarged schematic drawing of a bond made with the anvil of FIG. 15 and having a low ply twist level and flexible portions in the bond.
Figure 17:
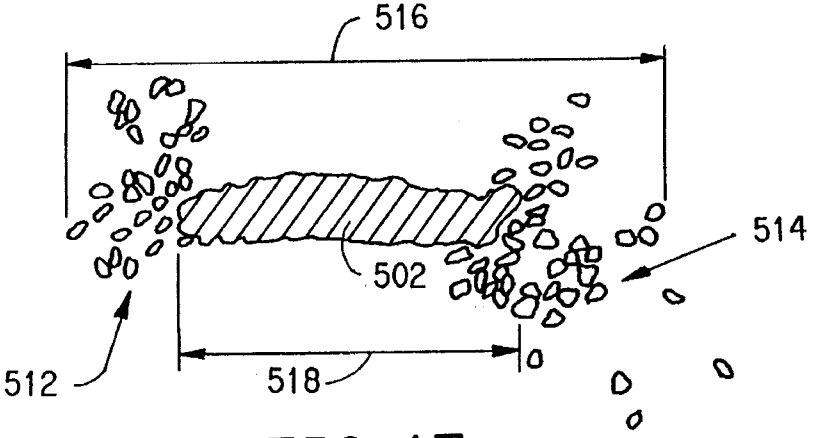
FIG. 17 is cross-section 17—17 of the bond of FIG. 16 showing a larger width fraction of loosely gathered filaments.

In FIG. 16 bond 500 has dense regions 502 and 504. Region 504*a* is a separated portion of dense region 504 where the adhesive joining appears discontinuous. Tracing strand 10*a* from right to left, it has a dense region 502, a less dense region 506, and another dense region 504/504*a*. The dashed lines 508 and 510 are a footprint of width 427 of anvil 412*a* on the yarn. Between the opposed edges of the bond and the dashed lines 508 and 510, the filaments are loosely gathered and represent an increased fraction of free filaments compared to other bonds of the invention. FIG. 17 shows cross-section 17—17 of FIG. 16 taken through dense region 502. The loosely gathered free filaments along the edges are seen as individual filament groups at 512 and 514. These are the filaments that were over the channels 423 and 425 when the horn 418 and anvil 412*a* came together. A rough measure of the fraction of loosely gathered free filaments is the distance across the bulk of the free filaments represented by bond width 516 compared to the distance across the dense region represented by width 518. The difference between these widths is the width of free filaments which can be compared to the bond width 516; this gives the width fraction of free filaments, which may be closely related to the dimensions of the channels in anvil 412*a*. For the bond shown, the width fraction of free filaments is about 44%. This bond minimizes the dense region of filaments in the bond, but without sacrificing adequate peel strength by having too small a dense region. This produces a reliably strong "soft" bond for use in a cut pile carpet.

The bonds of FIGS. 8, 9 and 14 have the preferred condition for reliable bonds that there is a high level of ply twist in the bond. This results in numerous overlaps as is shown by the dense regions in the bonds. It is not unusual that these dense regions are spaced closely together or are abutting as is shown in FIG. 14 for dense regions 492, 494, and 496. This close spacing of dense regions may result in a stiff bond which is not desirable for passing the yarn through a carpet tufting machine needle and through a carpet backing. This is particularly so if the bond happens to be in the eye of the needle as it penetrates the backing. In this case, a more flexible bond is preferred which is shown in the bond of FIG. 16. The ply twist level in the bond 500 is about the same as the twist level in the un-bonded plied yarn. This results in a less dense, flexible, bond portion 520 extending transversely from one edge of the plied yarn to the opposed edge and having a longitudinal length 521 between dense regions 502 and 504. In this less dense, flexible portion 520 there are very few filaments found to be adhesively joined so the filaments can move relative to one another and the bond can easily bend or flex at this flexible portion. The length 521 is at least as long as about 40%–50% of the plied yarn average diameter. This minimum length has been found to provide the desired bending flexibility to the bond without unnecessarily extending the length of the bond.

Figure 18:
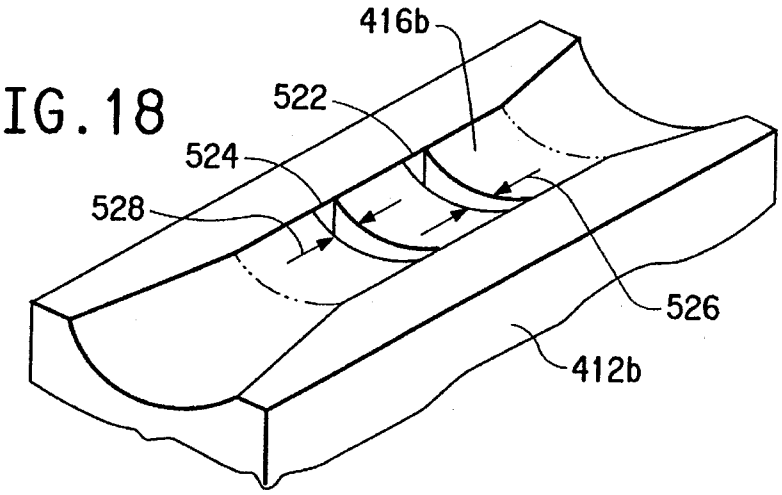
FIG. 18 is an isometric view of an anvil having slots transverse to the yarn path.

The flexible portion of FIG. 16 can also be obtained with any bonded ply twisted yarn, even bonds in the prior art, or bonds of the invention with high ply twist in the bond, by making the bond with an anvil having at least one slot provided transverse to the yarn where it is being bonded. FIG. 18 shows one embodiment of such an anvil by modifying anvil 412 of FIGS. 5 and 6 to produce anvil 412*b*. Transverse to groove 416*b* are two slots such as 522 and 524. Each slot has a length in the direction of the longitudinal path of the yarn, such as lengths 526 and 528, that is at least 40% of the plied yarn average diameter. The slots are shown terminating at the edge of radiused groove 416*b*, but for convenience of manufacture, they could be extended to the edge of the anvil and provide the same result of a flexible bond.

Figure 19:
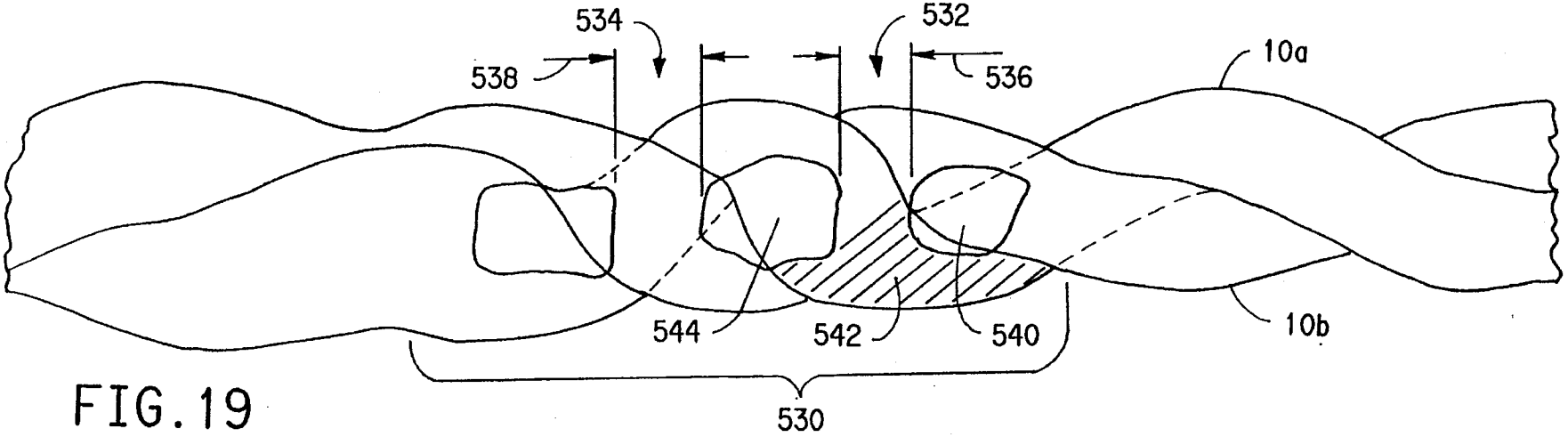
FIG. 19 is an enlarged schematic drawing of a bond made with the anvil of FIG. 18 showing flexible portions in the bond.

The bond resulting from anvil 412*b* used with horn 418 is shown as bond 530 in FIG. 19. Flexible portions 532 and 534 have longitudinal lengths 536 and 538 respectively that are at least 40% of the plied yarn average diameter. The bond can flex at these two flexible portions. The loosely gathered filaments in the flexible portions 532 and 534 are those that were over the slots 522 and 524 on anvil 412*b*. Notice that the overlapped strands may randomly fall at least partially over these slots when the bond is made. Strand 10*a* underlaps strand 10*b* where flexible portion 534 occurs in the bond. The length of the overlap and resulting dense region after bonding is usually longer than the length of the flexible portion, so this is not a problem; this could become a problem if the slot length is excessively long relative to the bond length and the twist level in the bond. The characteristic dense region/less dense region/dense region is present in this bond, as seen tracing strand 10*a* from right to left, where there is a dense region 540, a less dense region 542 and a dense region 544.

Any combination of bond embodiments may be useful for a particular purpose. For instance the low twist level can be combined with the bonds made with anvils 27 or 412 to provide the flexible portion in the bond of FIG. 16. One or more slots could also be added to anvils 27 or 412 to provide flexible portions regardless of the ply twist level in the yarn being bonded. Also, for instance, the slots in anvil 412*b* could be added to anvil 412*a* to provide multiple flexible portions combined with the higher width fraction of loosely gathered filaments in the bond of FIG. 16. The channels of anvil 412*a* could be added to anvil 27 to provide a higher width fraction of loosely gathered filaments in the bonds of FIGS. 9 or 14.

The flexible bonds of FIGS. 16 and 19 should provide a "softer" feel in a cut pile carpet even when the bond appears in one of the cut tufts. The flexible portion should bend more easily than the completely dense bonds of the referenced patents when subjected to a compressive force that will bend the bond in buckling or a side force that will simply bend the bond. The bond of FIG. 16 having the higher width fraction of loosely gathered filaments should also contribute to a "softer" bond when it appears in the cut tuft of a cut pile carpet. All of the strong, reliable bonds of the invention having multiple dense regions of adhesively joined filaments made with any of the horn and anvil combinations of the invention should provide higher quality, better looking carpets, especially cut pile carpets, since there are fewer occurrences of missed bonds that may result in fuzzy streaks in the carpets.

While the preferred embodiment of the invention has been described in terms of twisting a plurality of strands in the same direction, plying the twisted strands, clamping and bonding the plied twisted strands, then repeating the steps while twisting the strands in the opposite direction, it has been observed that as long as the twist in the single yarn strands is changed in some way from one node (or machine half-cycle) to the next, the yarns will ply together forming an alternate twist plied yarn. For instance, the strand twist in the first half-cycle can be a high "S" twist followed by a low "S" twist in the second half-cycle which will produce a low ply twist level in the yarn; the strand twist can be a high "S" twist followed by no twist which will produce a low/medium ply twist in the yarn; or the strand twist can be a low "S" twist followed by a high "Z" twist which produces a medium/high ply twist. For a high ply twist level, the preferred operation is to have the strand twist be a high "S" twist followed by a high "Z" twist, for instance. From one half-cycle to the next, however, it is only necessary that some change in strand twist occur which may be a change in level in the same direction, or a change in direction at the same level, or a combination of change in both level and direction.

Although the preferred embodiment is a fixed ultrasonic horn and an anvil moveable toward and away from the horn, alternatively the anvil could be fixed and the horn moveable toward and away from the anvil; relative motion between the two is all that is required. For ease of high speed motion, the lighter anvil is shown moveable instead of the heavier horn and ultrasonic hardware. Although the preferred embodiments discussed the groove, the channels, the slot, and the guides as part of the anvil, they could be made a part of the horn instead, or both the horn and anvil could have such features opposed to each other. For ease of manufacturing and to eliminate alignment requirements, the features are shown in the anvil only. While the preferred embodiment of the invention utilizes ultrasonic energy to bond the plied yarns together, one skilled in the art may apply other sources of energy such as radiant energy from lasers or other sources applied along the central axis of the squeezed strands. Also, other means of bonding such as adhesives or filament entanglement may be employed along the central axis of the squeezed strands. The bonds in any case should be small (less than the length of one turn of ply twist in the unbonded yarn), strong (about 25% of the singles yarn strength or greater) to ensure high reliability, and should be made with the yarns squeezed together with the strands overlapped as in the plied condition.

While the preferred embodiment of the invention describes a process of bonding alternate twist plied yarn in the plied state as part of a stop-and-go process, it is within the capabilities of one skilled in the art to practice plied yarn bonding in a continuous process. Such a process may be achieved, for example, by modifying the embodiment described herein by providing means to transport the ultrasonic bonder at a speed equal to a continuously moving yarn speed determined by the continuously rotating puller rolls. When it is desired to bond the plied yarn to form a node, the transport means would accelerate the bonder rapidly to reach and maintain the speed of the yarn. The bonder and torque jets would then operate as previously described when there is no relative motion between the yarn and the bonder. After releasing the yarn, the bonder would be rapidly reset to its start position by the transport means, ready for the next bond. The transported distance of the bonder should be as short as possible. Other methods of achieving no relative motion between the yarn and bonder may also be possible to achieve bonding of plied yarn in a process where the yarn is continuously moving.

What is claimed is:

1. An alternate twist-plied yarn formed from a plurality of strands of filaments ply-twisted in alternating directions in lengthwise intervals of first half-cycles of ply-twist followed by second half-cycles of ply-twist with a reversal node therebetween, there being a bond formed adjacent each node wherein the first half cycle is located within the bond and the second half-cycle of ply-twist originates at one end of the bond after the adjacent node, said bond comprising:

a first dense region having filaments adhesively joined together where a first strand overlaps a strand;

a second dense region along the length of the first strand having filaments adhesively joined together where the first strand underlaps a strand; and a third region along the length of the first strand and between the first and second dense regions where the first strand is arranged side-by-side with a strand, the third region being less dense than said first and second dense regions and having fewer of the filaments adhesively joined than in said first and second regions.

2. The alternate twist-plied yarn of claim 1 wherein the dense first and second regions have a higher peel resistance than the less dense region.

3. The alternate twist-plied yarn of claim 1, wherein the mean peel force of the dense regions along a length in the yarn is greater than three times the standard deviation for the peel force of the dense regions along said length.

4. An alternate twist-plied yarn formed from a plurality of strands ply-twisted in alternating directions in lengthwise intervals of first half-cycles of ply-twist having a number of twists per inch followed by second half-cycles of ply-twist with a reversal node therebetween, there being a bond formed adjacent each node wherein the first half-cycle of ply-twist extends into the bond and the second half-cycle of ply-twist originates at one end of the bond after the adjacent node, the number of twists per inch within the bond is greater than the number of twists per inch of the first half-cycle of ply-twist adjacent to the bond.

5. The alternate twist-plied yarn of claim 4 wherein the number of twists per inch within the bond is at least 20% greater than the number of twists per inch in the first half cycle of ply-twist adjacent to the bond.

6. An alternate twist-plied yarn formed from a plurality of strands of filaments ply-twisted in alternating directions in lengthwise intervals of first half-cycles of ply-twist followed by second half-cycles of ply-twist with a reversal node therebetween, there being a bond formed adjacent each node wherein the first half-cycle of ply-twist is located within the bond and the second half-cycle of ply-twist originates at one end of the bond after the adjacent node, said bond comprising:

a longitudinal portion within the bond extending from one lateral edge of the bond to the other lateral edge of the bond where the filaments of the ply-twisted strands are loosely gathered and freely moveable relative to adjacent filaments, thereby providing a flexible portion in the bond.

7. The alternate twist-plied yarn of claim 6 where the length of the longitudinal portion is greater than 40% of the average diameter of the twist-plied yarn.

* * * * *